US006095896A

United States Patent [19]

Kobayashi

[11] Patent Number: 6,095,896

[45] Date of Patent: Aug. 1, 2000

[54] EYEGLASS LENS GRINDING MACHINE

[75] Inventor: Masahiko Kobayashi, Aichi, Japan

[73] Assignee: Nidek Co., Ltd., Aichi, Japan

[21] Appl. No.: 09/143,577

[22] Filed: Aug. 28, 1998

[30] Foreign Application Priority Data

Aug. 29, 1997 [JP] Japan ..... 9-249399

[51] Int. Cl.[7] ..... B24B 49/00

[52] U.S. Cl. ..... 451/5; 451/8; 451/9; 451/43

[58] Field of Search ..... 451/5, 8, 9, 43

[56] References Cited

U.S. PATENT DOCUMENTS

| | | | |
|---|---|---|---|
| 5,138,770 | 8/1992 | Matsuyama | 33/28 |
| 5,228,242 | 7/1993 | Matsuyama | 51/165.74 |
| 5,333,412 | 8/1994 | Matsuyama | 51/165.71 |
| 5,347,762 | 9/1994 | Shibata et al. | 451/15 |
| 5,371,974 | 12/1994 | Lecerf et al. . | |
| 5,588,899 | 12/1996 | Gottschald . | |
| 5,775,973 | 7/1998 | Watanabe . | |
| 5,890,949 | 4/1999 | Shibata . | |

FOREIGN PATENT DOCUMENTS

| | | | |
|---|---|---|---|
| 3-20603 | 1/1991 | Japan | G01B 5/06 |
| 3-166050 | 7/1991 | Japan | B24B 9/14 |

*Primary Examiner*—Timothy V. Eley
*Assistant Examiner*—Willie Berry, Jr.
*Attorney, Agent, or Firm*—Sughrue, Mion, Zinn, Macpeak & Seas, PLLC

[57] ABSTRACT

An eyeglass lens grinding machine is provided in which a bevel can be easily formed on the periphery of an eyeglass lens in such a manner that those portions of the lens which will protrude from either the front or rear surface of an eyeglass frame are appropriately adjusted in areas where the edge thickness is great in order to achieve a good aesthetic appeal after the lens has been fitted in the frame. In the improved eyeglass lens grinding machine, the frame configurational data on the eyeglass frame and the layout data to be used in providing a layout of the lens corresponding to the eyeglass frame are entered. The edge position of a processed lens is detected on the basis of the entered data. A first bevel path is determined on the basis of the result of the detection. A second bevel path is obtained by tilting the first bevel path in such a way that it passes through a desired position on the lens edge and the bevelling of the lens is controlled on the basis of the second bevel path.

13 Claims, 7 Drawing Sheets

EYEGLASS LENS GRINDING MACHINE

BACKGROUND OF THE INVENTION

The present invention relates to an eyeglass lens grinding machine for grinding a lens to be fitted in an eyeglass frame.

A tapered edge commonly referred to as a "bevel" is formed on the periphery of an eyeglass lens so that the lens can be supported in a groove extending along an eyeglass frame. In general, a bevel corresponds in configuration to a lens by determining a curvature that conforms to the curved front surface of the lens to be processed or by dividing its edge thickness by a specified ratio.

Ordinarily, the methods described above are satisfactory but in special cases such as a lens having a strong positive or negative power and an EX lens, an increased portion of the lens will protrude from either the front or rear side of the rim on the frame in areas where the edge thickness is great and this detracts from the aesthetic appeal of the spectacles. As a further problem, if the eyeglass frame of interest has a strong curvature, the lenses that have been provided with a bevel curve by the above-described methods often fail to be fitted in the frame due to the excessive difference between the bevel curve and the curvature of the frame. In this case, forced bevelling is performed using a bevel curve in conformity with the curvature of the frame but then an even increased part of the lens will protrude from either the front or rear side of the rim on the frame in the areas where the edge thickness is great.

SUMMARY OF THE INVENTION

The present invention has been accomplished under these circumstances and has as an object of providing an eyeglass lens grinding machine that can easily form a bevel in such a manner that those portions of an eyeglass lens which will protrude from either the front or rear surface of an eyeglass frame are appropriately adjusted in areas where the edge thickness is great, thereby ensuring a good aesthetic appeal after the lens has been fitted in the frame.

The stated object of the invention can be attained by the following.

(1) An eyeglass lens grinding machine for processing a lens such that the lens is fitted in an eyeglass frame, the machine comprising:

data input means for entering frame configurational data on the eyeglass frame and layout data to be used in providing a layout of the lens relative to the eyeglass frame;

an edge position detecting means for detecting an edge position of the lens after processed on the basis of the frame data and the layout data entered by the data input means;

first bevel determining means for determining a first bevel path by calculation based on the result of detection by the edge position detecting means;

second bevel determining means for determining a second bevel path that is obtained by tilting the first bevel path such that the second bevel path passes through a desired position on a lens edge; and processing control means for controlling bevelling of the lens on the basis of the second bevel path.

(2) An eyeglass lens grinding machine as recited in (1), wherein the second bevel determining means comprises:

first setting means for setting a first reference point on the lens edge;

second setting means for setting a second reference point with reference to the first reference point, the second reference point being used for tilting the first bevel path; and shifting means for shifting the second reference point.

(3) An eyeglass lens grinding machine as recited in (2), wherein the shifting means includes input means for entering a bevel position on the lens edge which satisfies a specified positional relationship with the first reference point.

(4) An eyeglass lens grinding machine as recited in (3), wherein the specified positional relationship is such that the bevel position is on a line segment rotated through 180° with respect to the first reference point.

(5) An eyeglass lens grinding machine as recited in (2), wherein the second reference point that is to be set by the second setting means is a center point of the circle defined by the bevel's curve determined from the first bevel path.

(6) An eyeglass lens grinding machine as recited in (2), wherein the second reference point that is to be set by the second setting means is a center point of the circle defined by the bevel's curve determined from the first bevel path and the shifting means includes input means for entering data for shifting the center point of the circle defined by the bevel's curve.

(7) An eyeglass lens grinding machine as recited in (2), wherein the first setting means has designation means for designating the first reference point in a desired way in conformity with the general configuration to which the lens is to be proceeded.

(8) An eyeglass lens grinding machine as recited in (1), further comprising:

display means for providing a graphic representation of the bevel position relative to the lens edge on the basis of the edge position information as obtained by the edge position detecting means and the first or second bevel path, and wherein the second bevel determining means includes input means for entering the information necessary to determine the second bevel path while looking at the displayed graphics.

(9) An eyeglass lens grinding machine as recited in (1), further comprising:

display means for providing a graphic representation of the status of the tilt of the first or second bevel path relative to the lens edge on the basis of the edge position information as obtained by the edge position detecting means and the first or second bevel path.

(10) An eyeglass lens grinding machine as recited in (1), further comprising:

selection means for selecting either the first bevel path or the second bevel path.

(11) A system for controlling an eyeglass lens grinding apparatus to form a bevel on a peripheral edge of an eyeglass lens, the system comprising:

a memory storing therein a program for executing a method including the steps of:

calculating a bevel's curve;

setting a first position on the bevel's curve as a tilting reference position;

setting a tilting amount by which a second position on the bevel's curve is to be moved to a third position, the second position being located diametrically opposite from the first position;

offsetting a center of the bevel's curve within a plane containing the first and second positions and the center of the bevel's curve using a sphere equation indicative of the bevel's curve, positional data of the first and third positions, and radius data of the bevel's curve, thereby providing an offset center; and obtaining a tilted bevel curve using the offset center and the radius data of the bevel's curve; and a main arithmetic control circuit for creating bevelling information in accordance with the program and controlling the eyeglass lens apparatus in accordance with the bevelling information.

The present disclosure relates to the subject matter contained in Japanese patent application No. Hei. 9-249399 (filed on Aug. 29, 1997) which is expressly incorporated herein by reference in its entirety.

DETAILED DESCRIPTION OF THE PREFERRED EMBODIMENT

One embodiment of the present invention will now be described in detail with reference to the accompanying drawings.

Figure 1:
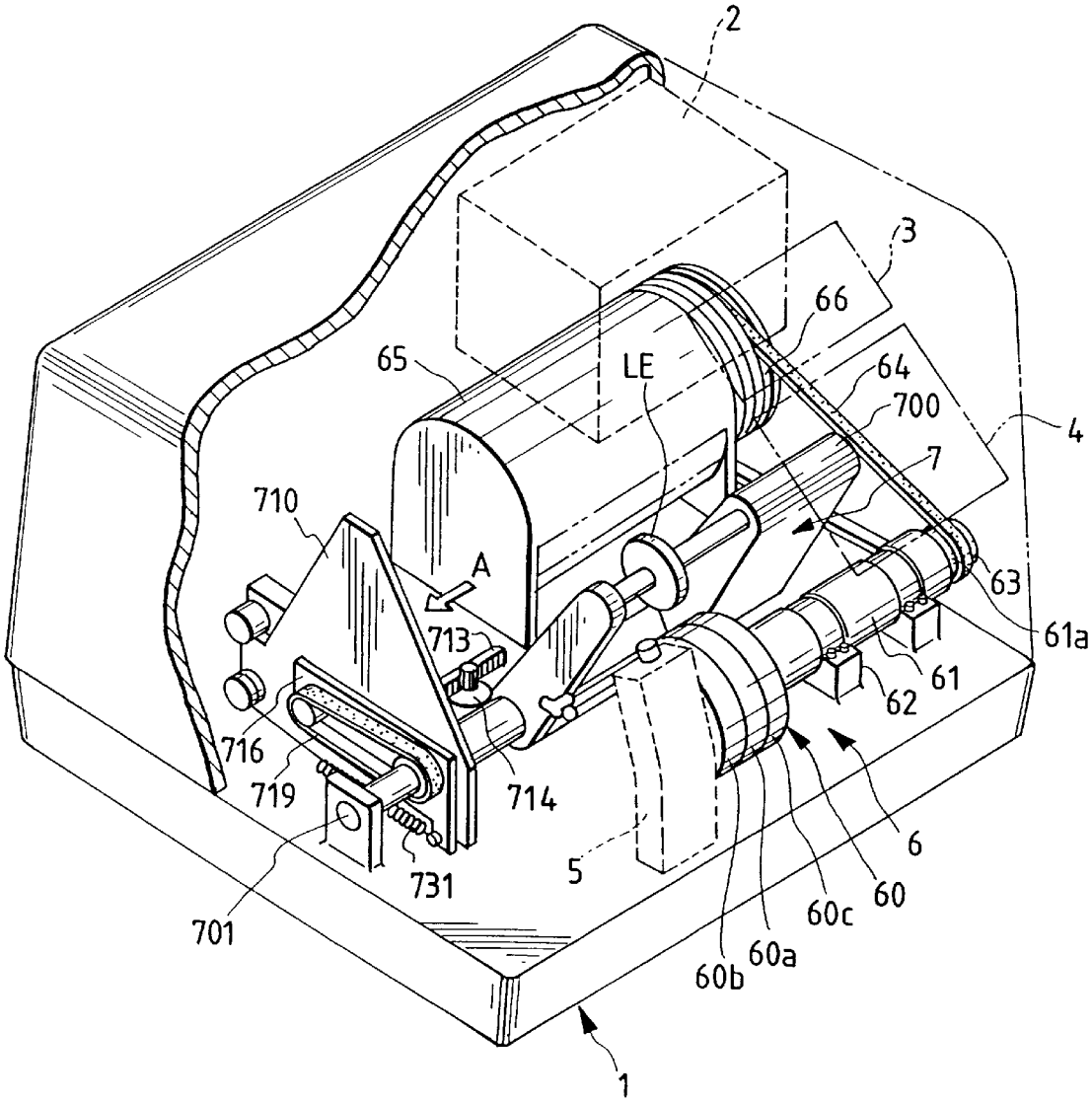
FIG. 1 is a perspective view showing the general construction of the eyeglass lens grinding machine of the invention.

FIG. 1 is a perspective view showing the general construction of an eyeglass lens grinding machine in accordance with the present invention. The reference numeral 1 indicates a machine base, on which the components of the lens grinding machine are arranged. The reference numeral 2 indicates an eyeglass frame configuration measuring device, which is incorporated in the upper section of the grinding machine and which is capable of obtaining configurational data on an eyeglass frame (or a template) (see commonly assigned U.S. Pat. No. 5,138,770). Arranged in front of the measuring device 2 are a display section 3, through which measurement results, calculation results, etc. are displayed in the form of characters or graphics, and an input section 4, at which data is entered or commands are given to the grinding machine. Provided in the front section of the grinding machine is a lens configuration measuring device 5 for measuring the configuration (an edge thickness) of a lens to be processed.

The reference numeral 6 indicates a lens grinding section, where an abrasive wheel group 60, which is composed of a rough abrasive wheel 60*a* for glass lenses, a rough abrasive wheel 60*b* for plastic lenses and a finishing abrasive wheel 60*c* for tapered edge (bevel) and plane machining, is rotatably mounted on a rotating shaft 61*a* of a spindle unit 61, which is attached to the base 1. The reference numeral 65 indicates an AC motor for abrasive wheel rotation, and the rotation of the motor 65 is transmitted to the abrasive wheel group 60 through a pulley 66, a belt 64 and a pulley 63 attached to the rotating shaft 61*a*. The reference numeral 7 indicates a carriage section, and the reference numeral 700 indicates a carriage.

Figure 2:
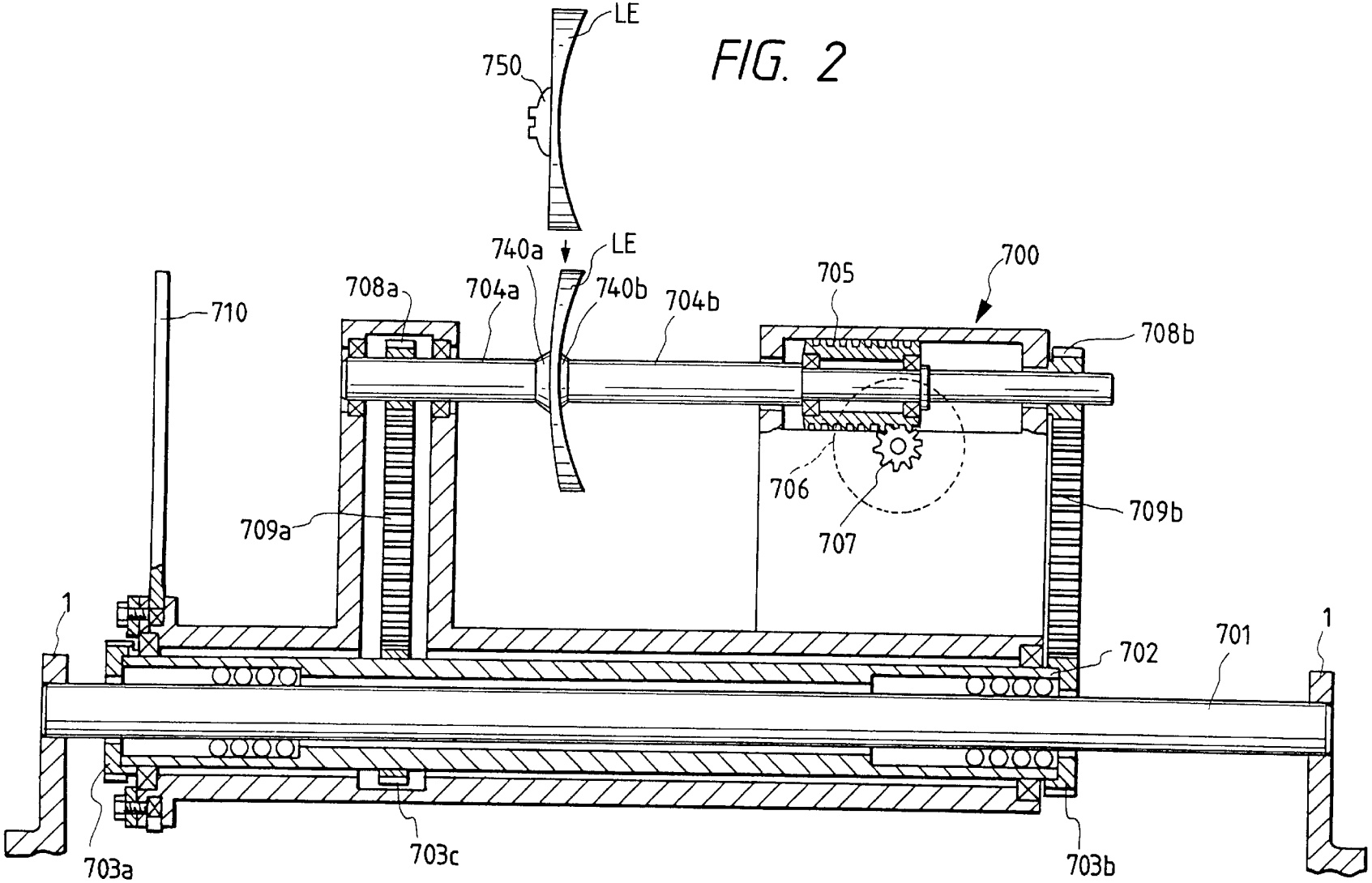
FIG. 2 is a cross-sectional view of a carriage.
Figure 3:
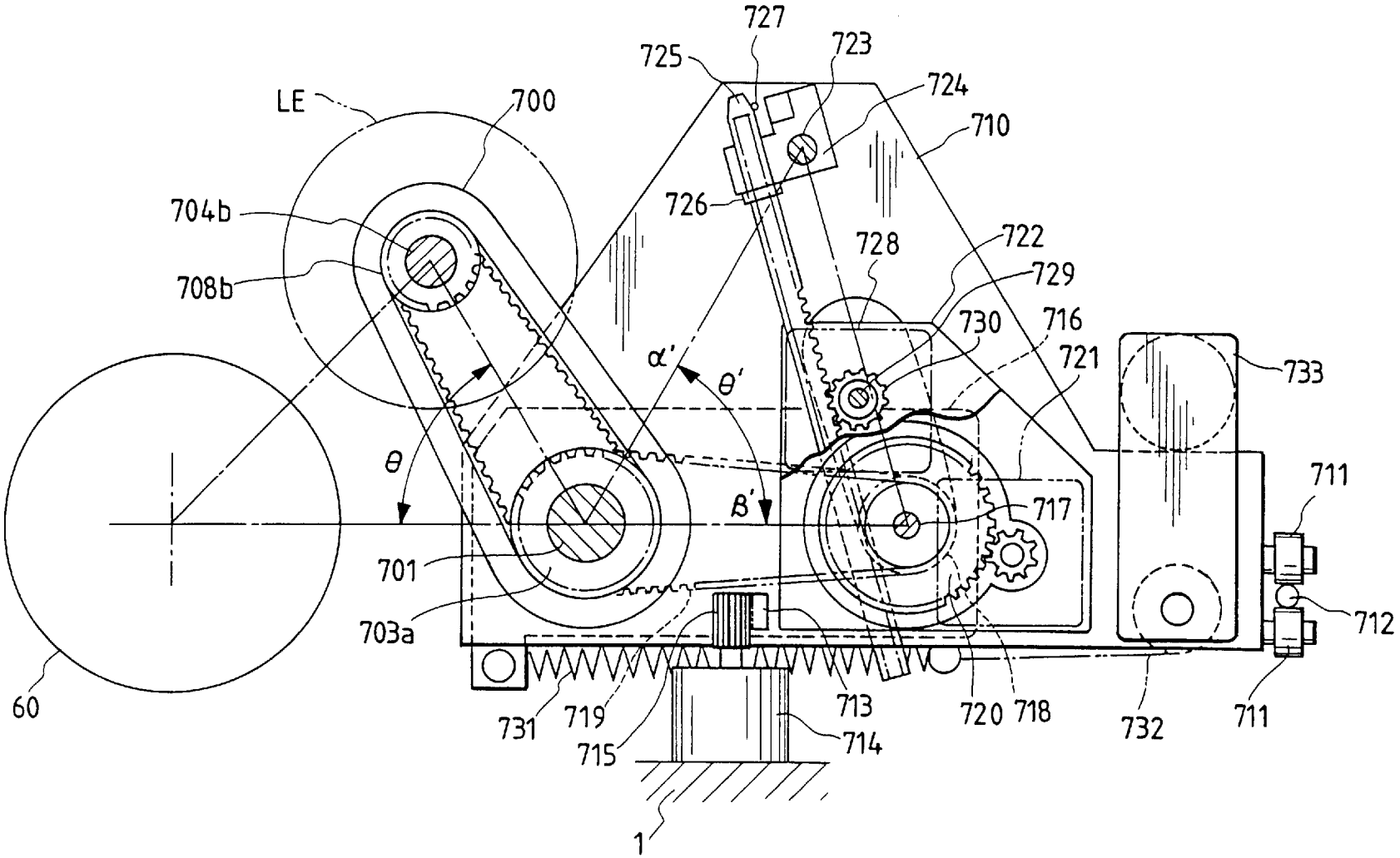
FIG. 3 is a diagram showing the drive mechanism of the carriage as viewed in the direction of arrow A of FIG. 1.

Next, a construction of main components will be explained. A construction of the carriage section 7 will be described with reference to FIGS. 1 to 3. FIG. 2 is a cross-sectional view of the carriage. FIG. 3 is a diagram showing a drive mechanism for the carriage, as viewed in a direction indicated by the arrow A in FIG. 1. A carriage shaft 702 is rotatably and slidably supported on a shaft 701 secured on the base 1, and further, the carriage 700 is rotatably supported on the carriage shaft 702. Lens rotating shaft 704*a* and 704*b* are coaxially and rotatably supported on the carriage 700, extending in parallel to the shaft 701. The lens rotating shaft 704*b* is rotatably supported in a rack 705 which is moved in the axial direction by a pinion 707 fixed on a rotational shaft of a motor 706. A cup receiver 740*a* is attached to the lens rotating shaft 704*a* for mounting a base of a fixing cup 750 fixed to a lens LE to be processed. A lens retainer 740*b* is attached to the lens rotating shaft 704*b*. With this arrangement, the lens LE to be processed is clamped between the lens rotating shafts 704*a* and 704*b*.

A drive plate 716 is securely fixed on the left end of the carriage 700, and a rotational shaft 717 is rotatably provided on the drive plate 716, extending in parallel to the shaft 701. A pulse motor 721 is fixed to a the drive plate 716 by a block 722. The rotation of the pulse motor 721 is transmitted through a gear 720 attached to the right end of the rotating shaft 717, a pulley 718 attached to the left end of the rotating shaft 717, a timing belt 719 and a pulley 703*a* to the shaft 702. Further, the rotation of the shaft 702 is transmitted through timing belts 709*a* and 709*b* and pulleys 703*b*, 703*c*, 708*a* and 708*b* to the lens rotating shafts 704*a* and 704*b*, to thereby rotate the lens rotating shafts 704*a* and 704*b* in synchronism with each other.

A rack 713 is fixed to an intermediate plate 710, and the rack 713 meshes with a pinion 715 attached to a rotating shaft of a carriage moving motor 714, so that the rotation of the motor 714 causes the carriage 700 to move in the axial direction of the shaft 701.

The carriage 700 is pivotably moved by a pulse motor 728. The pulse motor 728 is fixed to a block 722 so that a pinion 730 fixed to a rotating shaft 729 of the pulse motor 728 meshes with a round rack 725. The round rack 725 extends in parallel to the shortest line segment connecting the axis of the rotational shaft 717 and the axis of the shaft 723 fixed to the intermediate plate 710. The round rack 725 is held between the block 722 and a correction block 724 rotatably mounted on the shaft 723, so that the round rack 725 is slidably movable with a certain degree of freedom. A stopper 726 is fixed on the round rack 725 so as to restrict upward sliding movement of the round rack 725 upon contact with the correction block 724. With this construction, an axial distance r' between the rotational shaft 717 and the shaft 723 can be controlled in accordance with the rotation of the motor 728, and thus an axial distance r between each of the lens rotating shafts 704*a* and 704*b* and the abrasive wheel rotating shaft 61*a* can be controlled since the axial distance r has a linear relationship to the axial distance r'.

A sensor 727 is installed on the intermediate plate 710 so as to detect the contact condition between the stopper 726 and the correction block 724. Therefore, the grinding condition of the lens LE can be checked. A hook of a spring 731 is hung on the drive plate 716, and a wire 732 is hung on a hook on the other side of the spring 731. A drum is attached on a rotational shaft of a motor 733 secured on the intermediate plate 710, so that the wire 732 can be wound on the drum. Thus, the grinding pressure of the abrasive wheel group 60 for the lens LE can be changed.

The construction of this carriage section is basically the same as that disclosed by the commonly assigned U.S. Pat.

No. 5,347,762, so that the reference should be made thereto as to the detailed construction.

Figure 4A:
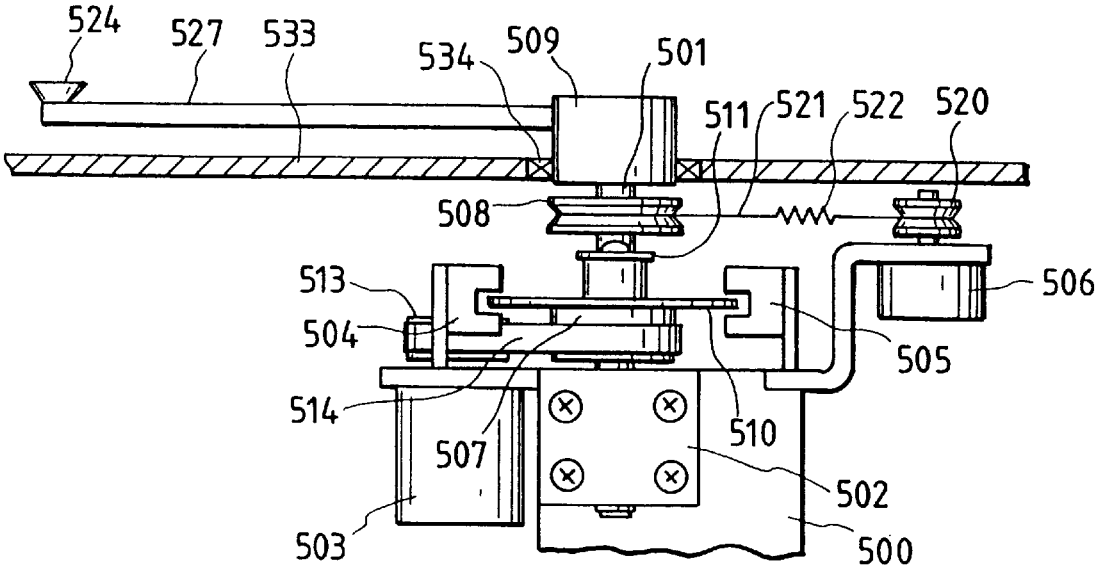
FIGS. 4A and 4B illustrate the construction of the lens configuration measuring device 5.
Figure 4B:
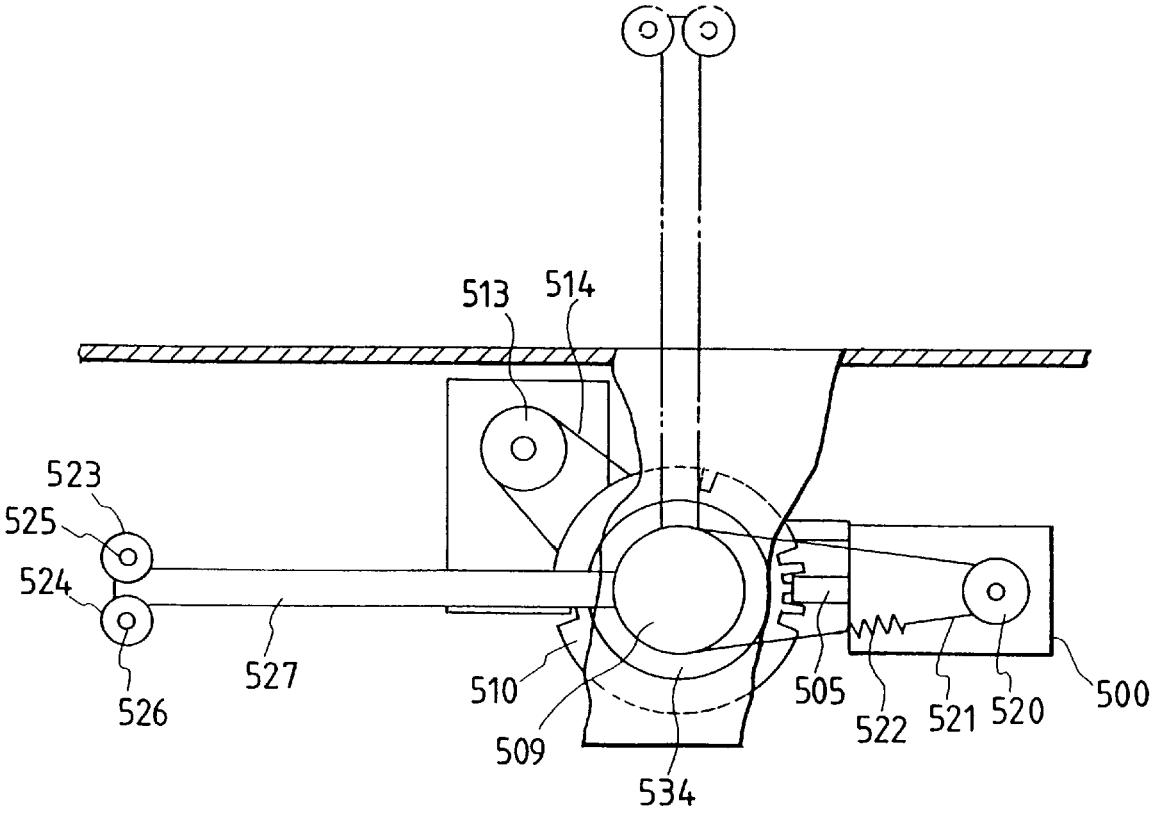

FIG. 4A is a cross-sectional view of a lens configuration measuring device 5, and FIG. 4B is a plan view of the same. The lens configuration device 5 includes: a measuring arm 527 having two feelers 523 and 524; a DC motor 503 for rotating the measuring arm 527, a rotating mechanism having a pulley 513, a belt 514, a pulley 507, a shaft 501, pulley 508 and so on; a sensor plate 510 and photoswitches 504 and 505 for detecting the rotation of the measuring arm 527 and controlling the rotation of the DC motor 527; a detection mechanism having a potentiometer 506 for detecting rotational amount of the measuring arm 527 to thereby obtain configurations on the lens front and rear surfaces. The construction of this lens configuration measuring device 5 is basically the same as that disclosed by the commonly assigned U.S. Pat. No. 5,347,762, so that the reference should be made thereto as to the detailed construction.

In order to measure the lens configuration (the edge thickness), the configurations on the lens front and rear refractive surfaces are determined such that the rotational amount of the pulley 508 is detected with the potentiometer 506 when the lens LE to be processed is rotated with the feeler 523 being allowed to abut against the lens front surface and then with the feeler 524 being allowed to abut against the lens rear surface.

Figure 5:
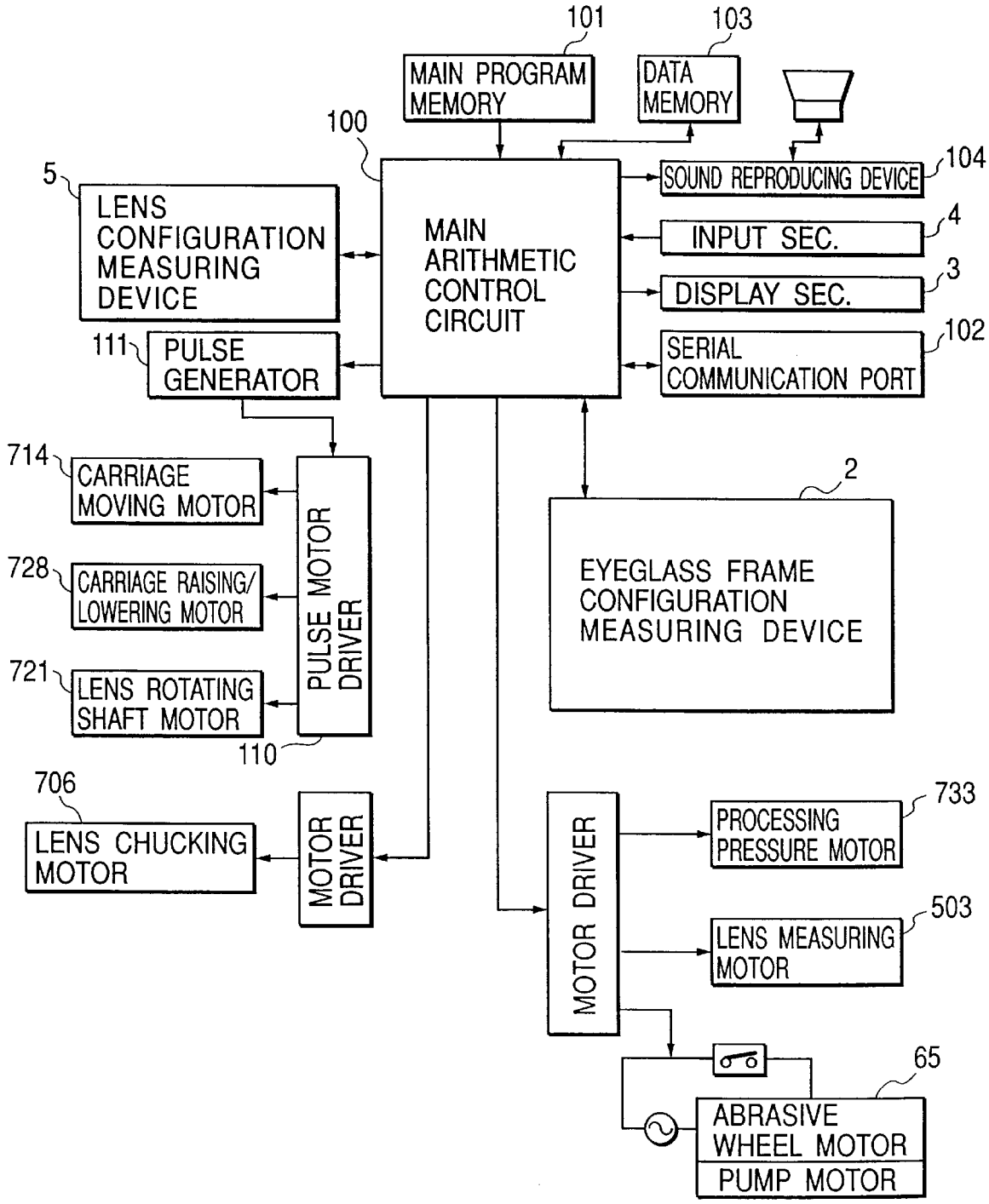
FIG. 5 shows the essential part of the block diagram of the electronic control system for the grinding machine.

FIG. 5 shows the essential part of a block diagram of the electric control system for the grinding machine. A main arithmetic control circuit 100 is typically formed of a microprocessor and is controlled by a sequence program stored in a main program memory 101. The main arithmetic control circuit 100 can exchange data with IC cards, eye examination system devices and so forth through a serial communication port 102, and perform data exchange and communication with an arithmetic control circuit of the eyeglass frame configuration measurement device 2. The eyeglass frame configurational data is stored in a data memory 103.

Connected to the main arithmetic control circuit 100 are a display section 3, an input section 4, a sound reproducing device 104, and the lens configuration measuring device 5. Data on the lens processing information and so on, which have been arithmetically processed in the main arithmetic control circuit 100, are stored in the data memory 103. The carriage moving motor 714, the carriage raising/lowering motor 728 and the lens rotating shaft motor 721 are connected to the main arithmetic control circuit 100 through a pulse motor driver 110 and a pulse generator 111. The pulse generator 111 determines the pulse number and the frequency (Hz) of the output to the respective pulse motors, i.e., controls the operation of the respective motors, in response to commands from the main arithmetic control circuit 100.

Having the above-described construction, the grinding machine of the invention will operate as follows. The following description assumes that a lens having a strong negative power with an extremely great edge thickness is processed in a forced processing mode that allows for changes in the bevel curve and its position (in the embodiment under discussion, tilting is enabled and this is one of the operations that can be performed in the forced processing mode by manipulation of the input section 4.)

First, the eyeglass frame configuration measuring device 2 is used to measure the configuration of an eyeglass frame. Data on the measurement of the eyeglass frame is obtained as three-dimensional information represented by ($r_n$, $\theta_n$, $z_n$) (n=1, 2, . . . , N). When the NEXT-DATA switch 417 in the input section 4 (for the following description of this switch and other switches in the input section 4, see FIG. 6) is pressed, the measurement data is transferred to the main arithmetic control circuit 100 and stored in the data memory 103. At the same time, a graphic representation of the lens configuration appears on the screen of the display section 3 based on the eyeglass frame configuration data and the grinding machine is ready for receiving the necessary processing conditions. The operator then touches various switches in the input section 4 to enter layout data such as the PD value of a user, the FPD value and the height of the optical center of the lens, as well as the processing conditions such as the constituent material of the lens to be processed, the constituent material of the frame and the mode of the processing to be done. According to the assumption made for the present embodiment, a forced processing mode is selected by pressing the MODE switch 404. When the entry of the necessary processing conditions is complete, the lens to be processed, which has been subjected to specified actions (e.g., axial alignment of the fixing cup 750), is chucked by the lens rotating shafts 704*a* and 704*b*. Thereafter, the START/STOP switch 411 is pressed to bring the grinding machine into operation.

In response to a start signal, the main arithmetic control circuit 100 activates the lens configuration measuring device 5 so as to measure the edge position of the lens which corresponds to the frame configuration data and the layout data. Thereafter, the main arithmetic control circuit 100 performs bevel calculations which, in accordance with a specified program, determine data on the apical path of bevelling to be performed on the lens based on the information about the edge position of the lens. At this stage, the bevel calculations may be performed to establish the bevel's apex at all points indicated by the radius vector such that the edge thickness is divided by a specified ratio (e.g., 3:7 from the front surface of the lens) (this process is hereinafter called "AUTO bevelling"). For details about the bevel calculations, reference should be made to the U.S. Pat. No. 5,347,762, etc.

When the bevel calculations end, the screen of the display section 3 switches to produce a simulated image on which the operator can alter the shape of the bevel to be formed. In the initial image, an approximate curve value that is determined from the data on the apical path of bevelling in the already described AUTO bevelling mode is displayed under the item "CURVE" 301. An approximate curve value for the eyeglass frame that has been measured with the eyeglass frame measuring section 2 is displayed under the item "FC" 302. The item "POSITION" 303 shows an offset to be entered, by which the bevel's apical path is translated in parallel toward either the front or rear surface of the lens, and the item "TILT" 304 shows data to be entered for tilting the bevel's apical path (to be described later).

The curve value to be displayed under item 301 may be determined by the following procedure. After determining any four points in the data for the bevel's apical path by the bevel calculations described, assume that said four points lie on a spherical surface having the same center (a, b, c) and the same radius r. A sphere is expressed by the following equation:

$$(x-a)^2+(y-b)^2+(z-c)^2=r^2 \quad \text{(Eq. 1)}$$

Substituting into this equation the data for the positions of the four given bevel's apices, one can determine the center (a, b, c) and the radius r of the sphere passing through said four points. This procedure is repeated for several (four or five) sets and their average is calculated. A curve value Crv can be determined from the resulting radius r of the sphere. The curve value Crv is a measure that conventionally expresses the curvature of the eyeglass lens and it is determined by the following equation:

$$Crv=(n-1)/r$$

where n is the refractive index of the lens and customarily set at 1.523. The curve value of the eyeglass frame can be determined by the same method (provided that data within a specified range of the upper portion of the frame may preferably be adopted for the case where the user has put on the spectacles).

The simulated image also shows the target lens configuration 310 based on the frame configuration data, a mark 311 indicating the position of a minimum edge thickness, a mark 312 indicating the position of a maximum edge thickness, and a rotational cursor 313 which designates the position of a radius vector for showing the bevel status in a bevel's profile display section 320. The rotational cursor 313 rotates counterclockwise as long as the "+" switch 409*a* is kept depressed and it rotates clockwise as long as the "−" switch 409*b* is kept depressed. As a result, the operator can ensure that the status of the bevel to be ultimately formed by processing is checked for the entire periphery of the lens.

If the bevel's apical path determined by the AUTO bevelling mode has an excessive difference from the curvature of the frame, the processed lens sometimes fails to be fitted in the eyeglass frame. To avoid this problem, the operator references the curve value displayed under the item "FC" 302 and adjusts the bevel to conform to the curvature of the frame. The procedure of this adjustment is as follows. By depressing either one of the two MOVE switches 408, the operator displays and puts a cursor of inverted display 300 onto the item 301. He then presses either the switch 409*a* or 409*b* to make an adjustment to the desired curve value. If he wants to translate the bevel to be formed, he puts the cursor 300 onto the item 303 and enters the amount of offset by which the bevel is to be translated. On the basis of the entered change in the data, the main arithmetic control circuit 100 determines the coordinates of the center point of the sphere on which the bevel's apex lies at the position of minimum edge thickness and recalculates the position of the bevel's apex from the determined coordinates of the center point and the radius of the bevel's curve as determined from the adjusted curve value. Alternatively, the path of bevel's apex that follows the curvature of the frame may be determined by adjusting the edge thickness dividing ratio to achieve an approximation to the bevel's curve corresponding to the curve value. For setting the bevel's curve, one of the following three methods may be selected as described in Japanese Patent Unexamined Publication No. 166050/1991: (1) designating four bevel positions on radius vectors; (2) designating three bevel positions on radius vectors and the radius of the bevel's curve; and (3) designating one bevel position on a radius vector, the radius of the bevel's curve and its center point.

Figure 7:
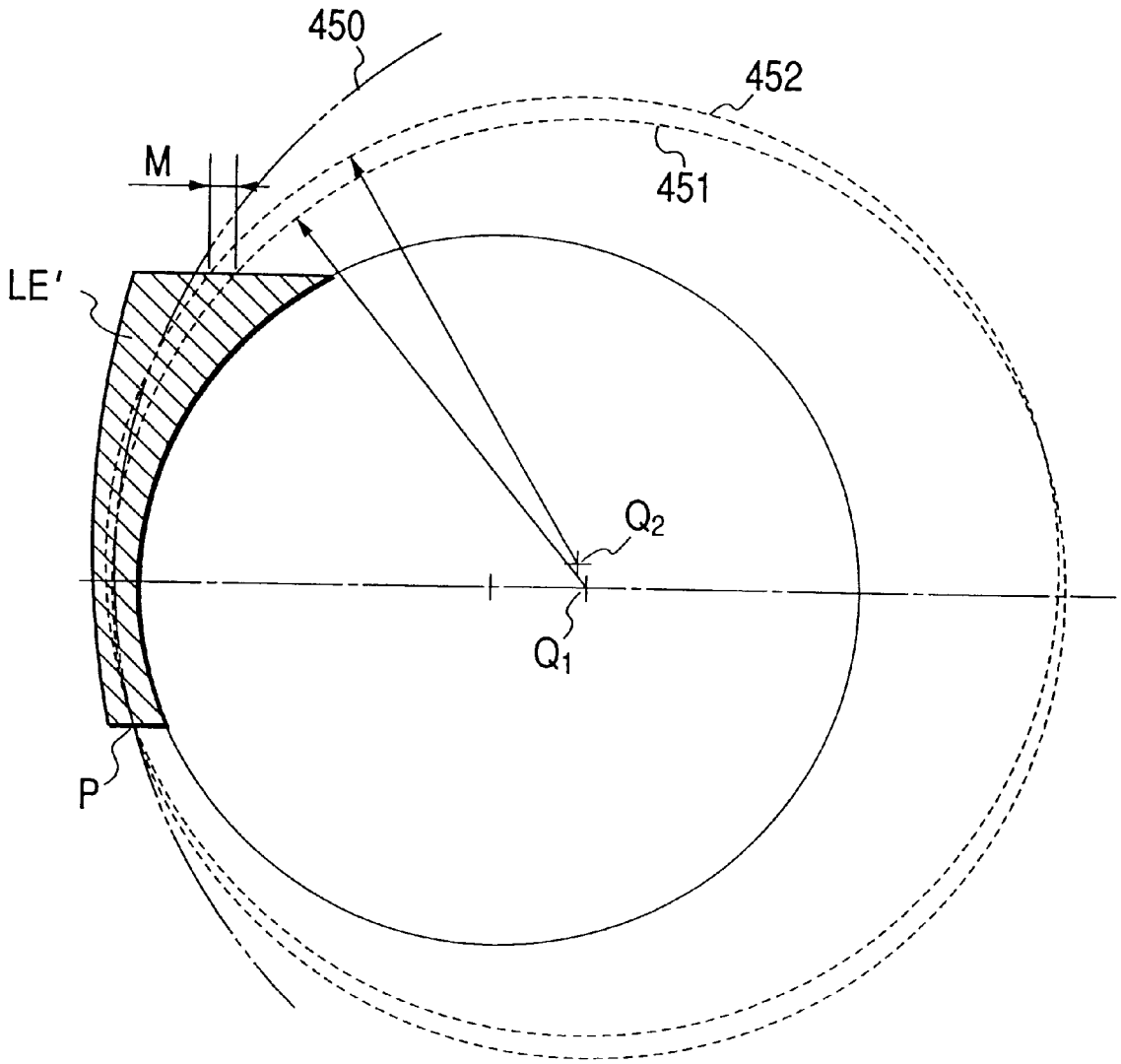
FIG. 7 is a diagram illustrating how a bevel's curve is tilted.

Described above is the way to establish a bevel's curve that follows the curvature of the frame and the term "bevel's curve" as used in the following description shall include the path of the bevel's apex that is constructed by dividing the edge thickness by a specified ratio. FIG. 7 shows a lens section LE' having a strong negative refractive power with an extremely thick edge. A problem with this lens is that the apex of the bevel in the thickest edge portion is situated closer to the rear surface of the lens, causing an increased portion of the lens to protrude from the rim on the eyeglass frame to the front side. In order to minimize the amount of such protrusion, one may tilt the bevel's curve.

Tilting of the bevel's curve determined in the manner described one paragraph before will now be explained with reference to FIG. 7, which is a two-dimensional diagram for the case of suppressing the forward protrusion of the lens portion on ear side given a setting of the bevel's curve. In FIG. 7, the two-dotted chain curve 450 represents the bevel's curve set in the AUTO bevelling mode, the dashed curve 451 represents the bevel's curve so set as to follow the curvature of the frame, and the other dashed curve 452 represents the bevel's curve after tilting the dashed curve 451 on a two-dimensional plane with reference to the edge position P. Stated briefly, the curve 452 is identical to the curve 451 except that the coordinates of the center point $Q_1$ of the circle (three-dimensionally, the sphere) defined by the curve 451 are shifted to the coordinates of the center point $Q_2$ of the circle defined by the curve 452. In this process of tilting, the position of the bevel's apex at the edge portion of the lens LE' on the ears side can be moved forward by a width of M while the bevel's curve remains the same. In other words, if one wants to move the bevel's apical position forward by the width M, he may shift the coordinates of the center point $Q_1$ for the dashed curve 451 to $Q_2$.

Figure 6:
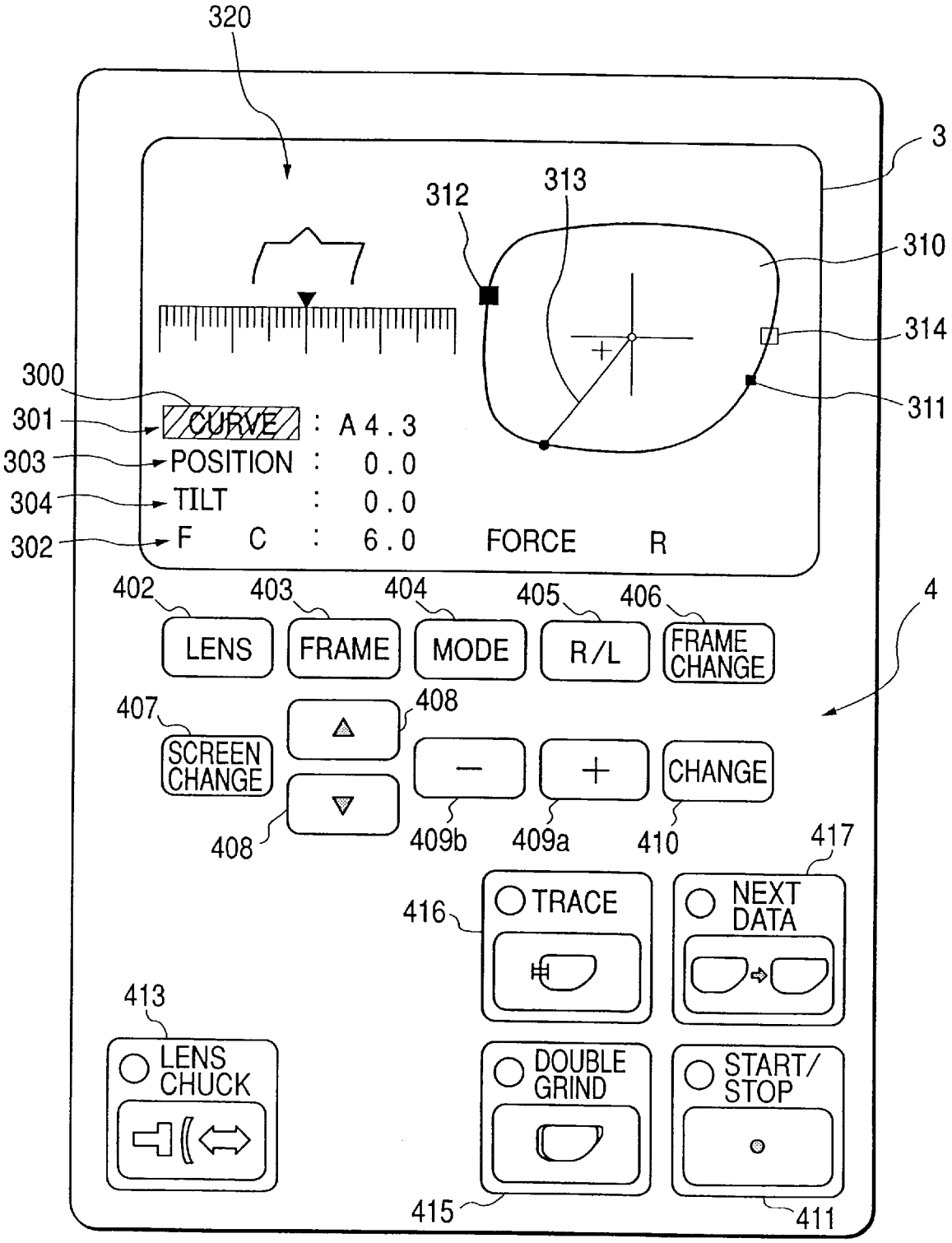
FIG. 6 is a diagram showing the outer appearance of a display section and an input section, with various pieces of information and graphic representation being displayed on the screen.

A specific procedure to establish settings for the tilting of the bevel's curve with the machine in the embodiment under consideration will now be described with reference to the simulated image shown in FIG. 6. First, the operator presses either one of the two MOVE switches 408 in the input section 4 to turn off the cursor 300 of inverted display. He then presses the "+" switch 409*a* or "−" switch 409*b* to move the rotating cursor 313 to the position of the radius vector he wants to use as a reference in the tilting process. For instance, he may put the cursor 313 onto the mark 311 indicating the position of minimum edge thickness (the problem of "uneven bevelling" will not usually occur if the reference position is set for the minimum edge thickness and, hence, automatic setting of the reference position for bevelling is a recommended practical approach). If the operator presses the CHANGE switch 410, a mark 314 indicating the reference position for tilting (in the initial state, this mark is located in the center of the nose side of the lens and thereafter it is located in the position set one processing cycle before) moves to the position of the mark 311 and, at the same time, the cursor 313 rotates by 180° to move to the opposite position. In the reference position for tilting, the bevel position will not change despite the change in the amount of tilting; however, in the diametric opposite position, the effect of the change in the amount of tilting is great enough to provide ease for the operator to check the change in the bevel position. The bevel display 320 provides a graphic representation of the bevel's status at the position of vector radius to which the cursor 313 has moved.

In the subsequent step, the operator pushes the MOVE switch 408 to display the inverted cursor 300 and put it onto the item "TILT" 304. Thereafter, the operator pushes the switch 409*a* or 409*b* to enter the amount of movement of the bevel's apical position on the side 180°-opposite from the reference position for tilting with respect to the center of processing. If "−2.0" is entered, the bevel's curve is tilted such that the bevel's apical position 180°-opposite from the reference position for tilting is shifted toward the front surface of the lens by 2.0 mm. Thus, the center point for the bevel's curve to be tilted is shifted on a plane passing through the following three points: (1) the point in the reference position for tilting; (2) the point 180°-opposite from the reference position for tilting; and (3) the center point for the bevel's curve before tilting. Since the radius of the bevel's curve is the same before and after tilting, one can uniquely determine the coordinates of the center point for the tilting bevel's curve by substituting the data of the following two points into the sphere's equation (1): the reference position for tilting and the bevel's apical position the amount of which movement has been determined by the entry under the item "TILT" 304. After the center point being thusly determined, the spherical surface defined by that center point and the radius of the designated bevel's curve is rendered to correspond to the information about the radius vector of the lens, whereby the data on the bevel's apical path is produced. This data is used as the information about the bevelling to be performed. It should be noted that the setting of the tilt of the bevel's curve is restricted such that the bevel's apex will not deviate from either the front or rear surface of the lens. Otherwise, the lens processing operation will not be started.

The bevel's status modified by tilting the bevel's curve is checked on the bevel display section 320. If there is no problem, the operator presses the START/STOP switch 411 to start the processing operation.

The main arithmetic control circuit 100 controls the action of the carriage section 7 and executes the processing operation according to a specified sequence. First, the carriage 700 is moved such that the chucked lens will lie on the rough grinding wheel determined by designating the constituent material of the lens. On the basis of the information for rough grinding, the drive of the associated motors is so controlled as to perform the appropriate processing of the lens. Subsequently, the lens is disengaged from the rough grinding wheel and positioned right above the bevelling groove of the finishing abrasive wheel 60*c*. Then, on the basis of the bevelling information, the drive of the associated motors is so controlled as to perform the intended bevel finishing operation.

When establishing settings for the tilting of the bevel's curve in the embodiment described above, the bevel's apical position at the lens edge is moved but this is not the sole case of the invention and the coordinates of the center point for the bevel's curve may be shifted. In the embodiment, the bevel's curve that has been so set as to follow the curvature of the frame is tilted but this is not the sole case of the invention and the bevel's apical path that has been set in the AUTO bevelling mode (by dividing the edge thickness by a specified ratio) may be tilted. The path of the apex of the bevel to be formed in the edge portion of the lens is preferably represented graphically in the display section 3 for both before and after tilting similarly to the case shown in FIG. 7. This helps the operator clearly recognize the state of the changing bevel's apical path in close relationship with the position of the lens edge. Further clarity can be ensured by giving a graphic representation of the path as it is seen from more than one direction and this permits the bevel's curve to be tilted in a more positive way.

The machine of the invention may be so adapted that if the bevel's apical path established in the AUTO bevelling mode is found to depart greatly from the curvature of the frame, it automatically corrects the bevel's apical path to approximate the curvature of the frame before the bevel's curve is tilted; alternatively, the machine may be so adapted as to automatically tilt the bevel's curve if the thickness of the lens edge exceeds a specified value. In these alternative cases, the amount of the tilt to be applied is determined in close relationship with the edge thickness to ensure that no part of the lens periphery will have an unevenly shaped bevel. The machine may also be adapted to give graphic representations of several bevel's apical path for both before and after tilting, as well as several cross-sectional profiles of the bevel to be formed, from which the operator selects a suitable path and profile by pressing the CHANGE switch 410.

As described on the foregoing pages, the present invention offers the advantages that even an unskilled operator can perform a bevelling operation on thick-edged eyeglass lenses in such a way that the portion of the lens edge that protrudes from the frame to either the front or rear side is appropriately adjusted to ensure a good aesthetic appeal after the lenses are fitted in the frame.

What is claimed is:

1. An eyeglass lens grinding machine for processing a lens so that the lens fits in an eyeglass frame, said machine comprising:

data input means for entering frame configurational data on the eyeglass frame and layout data to be used in providing a layout of the lens relative to the eyeglass frame;

an edge position detecting means for detecting an edge position of the lens after processing on the basis of the frame data and the layout data entered by said data input means;

first bevel path determining means for determining a first bevel path by calculation based on the result of detection by said edge position detecting means;

second bevel path determining means for determining a second bevel path based on said first bevel path such that said second bevel path passes through a desired position on a lens edge, and said second bevel path is located on a second spherical surface obtained by offsetting a center of a first spherical surface, wherein if the first bevel path is located on a spherical surface, the spherical surface is identical to the first spherical surface, and if the first bevel path is not located on a spherical surface, a spherical surface is approximated, and the approximated spherical surface is used as the first spherical surface; and processing control means for controlling bevelling of the lens on the basis of said first bevel path or said second bevel path.

2. An eyeglass lens grinding machine as recited in claim 1, wherein said second bevel path determining means comprises:

first setting means for setting a first reference point on the lens edge;

second setting means for setting a second reference point with reference to said first reference point, said second reference point being used for tilting said first bevel path; and shifting means for shifting said second reference point.

3. An eyeglass lens grinding machine as recited in claim 2, wherein said second setting means sets a bevel apex position on the first bevel path as the second reference point, the bevel apex position having a specified positional relationship with respect to the first reference point; and said shifting means includes input means for entering data for shifting the bevel apex position.

4. An eyeglass lens grinding machine as recited in claim 3, wherein said second setting means sets the bevel apex position as the second reference point, the bevel apex position being on a meridian rotated through 180° with respect to said first reference point.

5. An eyeglass lens grinding machine as recited in claim 2, wherein said second setting means sets the center of the first spherical surface as the second reference point.

6. An eyeglass lens grinding machine as recited in claim 2, wherein said second setting means sets the center of the first spherical surface as the second reference point; and said shifting means includes input means for entering data for shifting the center point of the first spherical surface.

7. An eyeglass lens grinding machine as recited in claim 2, wherein said first setting means has designation means for designating said first reference point in a desired way in conformity with a general configuration to which the lens is to be proceeded.

8. An eyeglass lens grinding machine as claimed in claim 2, wherein the first setting means sets a position of a minimal edge thickness as the first reference point.

9. An eyeglass lens grinding machine as recited in claim 1, further comprising:

display means for providing a graphic representation of a bevel apex position of at least one of said first and second bevel path relative to the lens edge on the basis of the edge position information as obtained by said edge position detecting means and at least one of said first and second bevel path.

10. An eyeglass lens grinding machine as recited in claim 1, further comprising:

display means for providing a graphic representation of a status of a tilt of at least one of said first and second bevel path relative to the lens edge on the basis of the edge position information as obtained by said edge position detecting means and at least one of said first and second bevel path.

11. An eyeglass lens grinding machine as recited in claim 1, further comprising:

selection means for selecting either said first bevel path or said second bevel path, wherein said processing control means controls beveling of the lens based on a result of selection of said selection means.

12. A system for controlling an eyeglass lens grinding apparatus to form a bevel on a peripheral edge of an eyeglass lens, said system comprising:

a memory storing therein a program for executing a method including the steps of:

calculating a bevel path;

setting a first position on said bevel path as a tilting reference position;

setting a tilting amount by which a second position on said bevel path is to be moved to a third position, said second position being located diametrically opposite from said first position;

offsetting a center of a spherical surface wherein the spherical surface is a spherical surface on which the bevel path is located, or an approximated spherical surface obtained by using a sphere equation if the bevel path is not located on a spherical surface, the spherical surface to be offset passing on a first position and a second position, and a spherical surface obtained by offsetting passes on the first position and a third position; and obtaining a tilted bevel path using offset spherical data and lens edge data; and a main arithmetic control circuit for creating bevelling information in accordance with said program and controlling said eyeglass lens grinding apparatus in accordance with said bevelling information.

13. A system for controlling an eyeglass lens grinding apparatus as claimed in claim 12, wherein the first position includes a position of a minimal edge thickness.

* * * * *